US006062914A

United States Patent [19]

Fasano

[11] Patent Number: 6,062,914

[45] Date of Patent: May 16, 2000

[54] CIRCUIT BREAKER PLUG IN BRACKET AND AUXILIARY/ALARM SWITCH CONNECTOR FOR USE THEREWITH

[75] Inventor: Michael Fasano, Waterbury, Conn.

[73] Assignee: Carlingswitch, Inc., Plainville, Conn.

[21] Appl. No.: 09/271,415

[22] Filed: Mar. 17, 1999

[51] Int. Cl.[7] ..... H01R 9/26

[52] U.S. Cl. ..... 439/716; 361/825; 361/363; 361/353; 361/376; 361/361

[58] Field of Search ..... 439/716, 532, 439/346; 361/634, 635, 652, 673; 335/13; 200/300, 293

[56] References Cited

U.S. PATENT DOCUMENTS 3,720,891 3/1973 Nicol ..... 335/13
4,454,565 6/1984 Krasij et al. ..... 361/376
4,713,728 12/1987 Raabe et al. ..... 361/363
4,900,275 2/1990 Fasano ..... 439/716
4,926,148 5/1990 Cambreleng ..... 335/13

*Primary Examiner*—Steven L. Stephan
*Assistant Examiner*—Amir Abdulmelik
*Attorney, Agent, or Firm*—McCormick, Paulding & Huber LLP

[57] ABSTRACT

A low profile mounting bracket carries coupling connector blocks that mate with load and line terminals of a molded split case circuit breaker housing. The housing defines a well for receiving an alarm or auxiliary switch, and the switch is received in a central opening in the bracket with the switch terminals in turn received in a connector that fits into the same central opening. Finally, a PC board is used to electrically connect each switch to external circuitry that may generate alarms or otherwise affect the circuit breaker's operation.

6 Claims, 5 Drawing Sheets

CIRCUIT BREAKER PLUG IN BRACKET AND AUXILIARY/ALARM SWITCH CONNECTOR FOR USE THEREWITH

BACKGROUND OF THE INVENTION

This invention relates generally to split case magnetic circuit breakers of the type having an auxiliary or alarm switch well defined in the circuit breaker case for receiving either a switch, or a filler block or a support block for auxiliary terminals and located generally between the main load and line terminals of the split case circuit breaker.

Prior U.S. Pat. No. 4,760,226 illustrates such a split case molded rectangular circuit breaker having first and second mating sections each of which comprise one half the overall housing for the breaker components. The switch case has a well for receiving the auxiliary switch or filler block and the well is defined by edges that include grooves to receive marginal edge portions of the filler block or the auxiliary switch as the case may be. In a typical installation several such circuit breakers would be stacked one adjacent to another and all the breakers appropriately mounted to a back plane or panel.

The general object of the present invention is to provide a unique mounting bracket for a stack of such circuit breaker housings of the split case type and that is especially designed to accommodate auxiliary switches in each of the wells of each circuit breaker, and to provide a convenient electrical connection not only for the load and line terminals of the circuit breaker, but also for the terminals of an auxiliary switch provided in the circuit breaker well.

SUMMARY OF THE INVENTION

In accordance with the present invention the split case molded circuit breaker defines a well for accommodating an electrical switch, or a filler in the event that no switch is provided in that particular circuit breaker. The circuit breaker housing has depending line and load male terminals, and an auxiliary switch may be provided in the circuit breaker well with associated switch terminals for connection to alarm circuits of the like. Such an auxiliary switch may include normal close, normal open terminals, and a ground terminal. For a more detailed explanation of the purpose served by such an auxiliary switch in connection with a magnetic circuit breaker the reader is referred to the prior U.S. Pat. No. 4,760,226 which patent is incorporated by reference herein.

In further accordance with the present invention, a circuit breaker mounting bracket is provided with a central opening for receiving both the circuit breaker well and an electrical switch provided therein. This bracket further includes line and load terminal cavities spaced from the central opening which receives the circuit breaker well, and female conductive terminals are provided in line and load terminal cavities of the bracket for receiving the depending line and load circuit breaker terminals of the circuit breaker respectively.

More particularly, the female conductive terminals comprise conductive connection means for coupling the line and load male terminals of the circuit breaker with the line and load wiring from the back panel to which the circuit breaker mounting bracket is secured.

The back panel to which the circuit breaker mounting bracket is secured also supports a narrow printed circuit board which carries conductive traces that are in turn connected to the terminals of the auxiliary switch in each of the molded split case circuit breakers provided in a stack of such circuit breakers on the panel by means of the said brackets.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanied drawings wherein.

DETAILED DESCRIPTION

Figure 1:
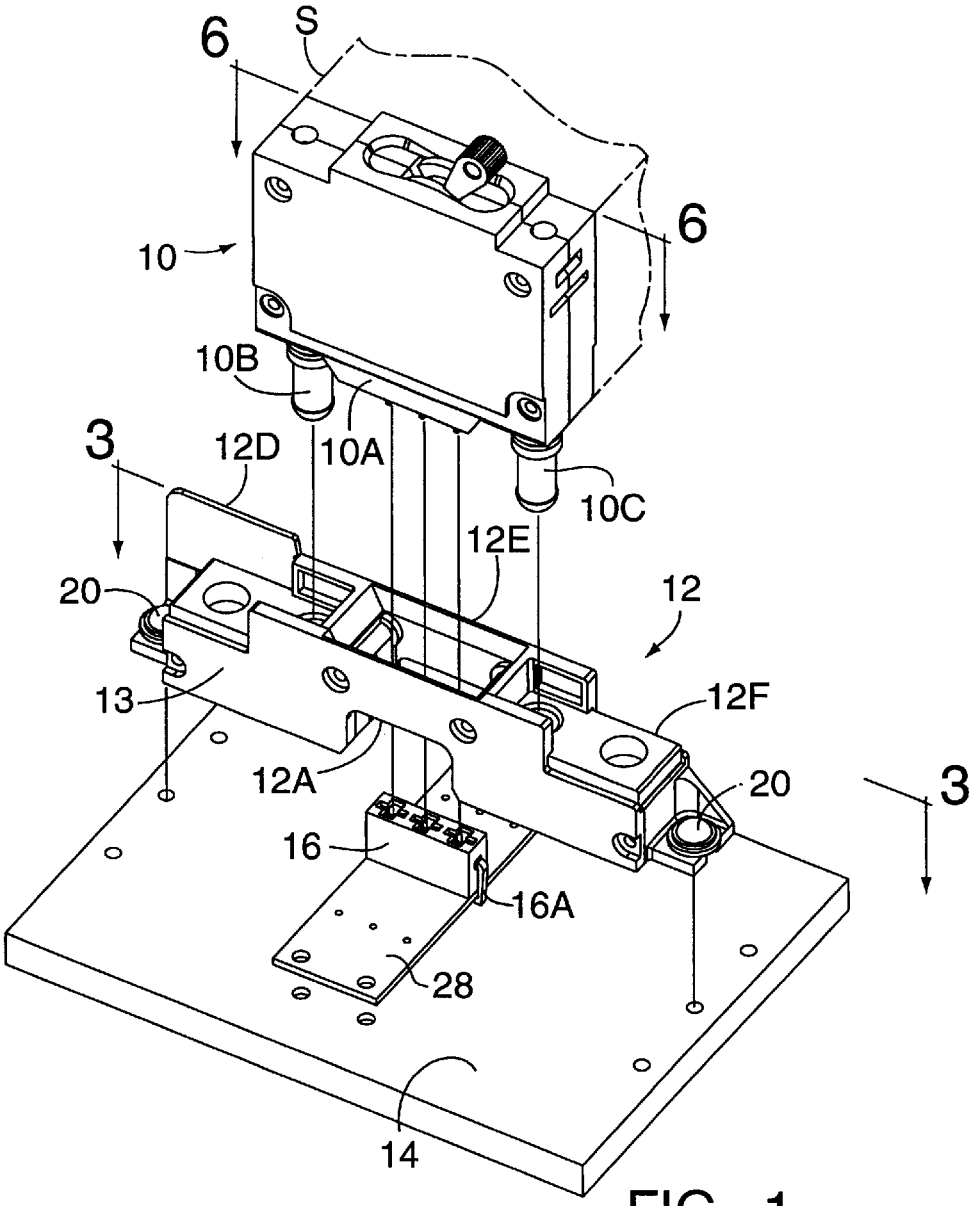
FIG. 1 is an exploded perspective view of a circuit breaker and associated circuit breaker mounting bracket together with a back panel and circuit board adapted for assembly in accordance with present invention.

Turning now to the drawings in greater detail, FIG. 1 shows a stack as represented by the single circuit breaker 10 of the type which is advantageously accommodated by a plurality of brackets such as indicated at 12 in providing the circuit breaker stack in closely spaced relationship to the back plane or panel 14 in a typical electrical enclosure.

As shown each breaker 10 is provided in a low profile mounting bracket 12, and in accordance with the present invention, each circuit breaker 10 has a depending well in its lower wall as indicated generally at 10A, which well is adapted to accommodate an auxiliary switch or alarm switch all as described in greater detail in the above mentioned prior U.S. Pat. No. 4,760,226 assigned to the assignee herein and issued Jul. 26, 1988.

Figure 12:
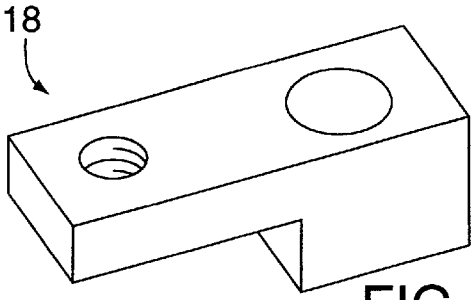
FIG. 12 is an isometric view of one of the connector blocks in the bracket of FIG. 11.

The auxiliary switch has depending spade terminals adapted to be received in slots provided for this purpose and an auxiliary switch connector 16 that is received in a central opening provided for this purpose in the mounting bracket 12. The circuit breaker 10 is of the split case molded type with an internal magnetic operating mechanism, all as described in the above mentioned U.S. Pat. No. 4,760,226. However, in the version shown in the disclosure herein the circuit breaker 10 has generally cylindrically shaped load and line terminals 10B and 10C which are adapted to be tightly received in openings provided for this purpose in a conductive coupling means provided for this purpose in the bracket 12, and illustrated in greater detail in FIG. 12.

The circuit breaker 10 is otherwise of generally conventional configuration and adapted to receive (optionally) an auxiliary or alarm switch all as described in the above mentioned U.S. Pat. No. 4,760,226. In accordance with the present invention a low profile brackets of the type illustrated at 12 is provided in a stack, one bracket for each breaker, on a back plate or panel 14. Each circuit breaker 10, in the stack is provided with input or output signals from conventional alarm switches provided in each of the wells in the bottom wall of such circuit breakers all in a manner to be described. It will be apparent that these brackets 12 can be stacked one adjacent to another so that a rear wall 12D of each of the brackets 12 can extend across the entire length of the bracket defining a bridging section 12E which is connected to the opposite end 12F of the bracket 12 thereby defining an opening 12A between the bracket end portions 12E and 12F for receiving an auxiliary switch connector 16 as referred to previously.

Figure 2:
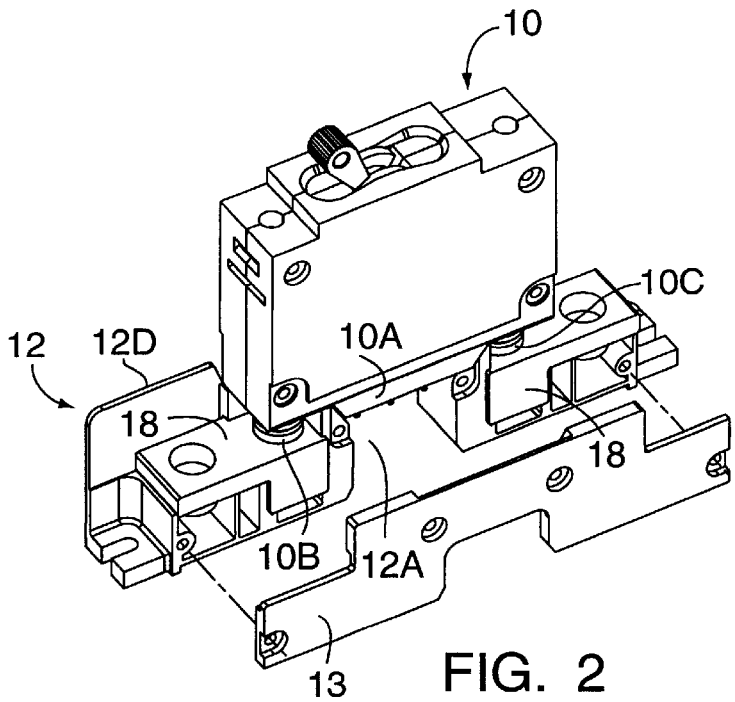
FIG. 2 is a perspective view showing the circuit breaker in a similar relationship with its mounting bracket.

Still with reference to the low profile bracket 12 it will be apparent that the bracket associated with the endmost circuit breaker in the stack requires a plate such as shown generally at 13 in FIG. 2. All other brackets 12 in the stack or circuit breaker/bracket assembly does not require such a plate 13, the wall 12D serving to separate the adjacent brackets, and provide cavities or recesses for receiving the electrically conductive coupling blocks indicated generally at 18, 18 in FIGS. 2 and 12.

Figure 9:
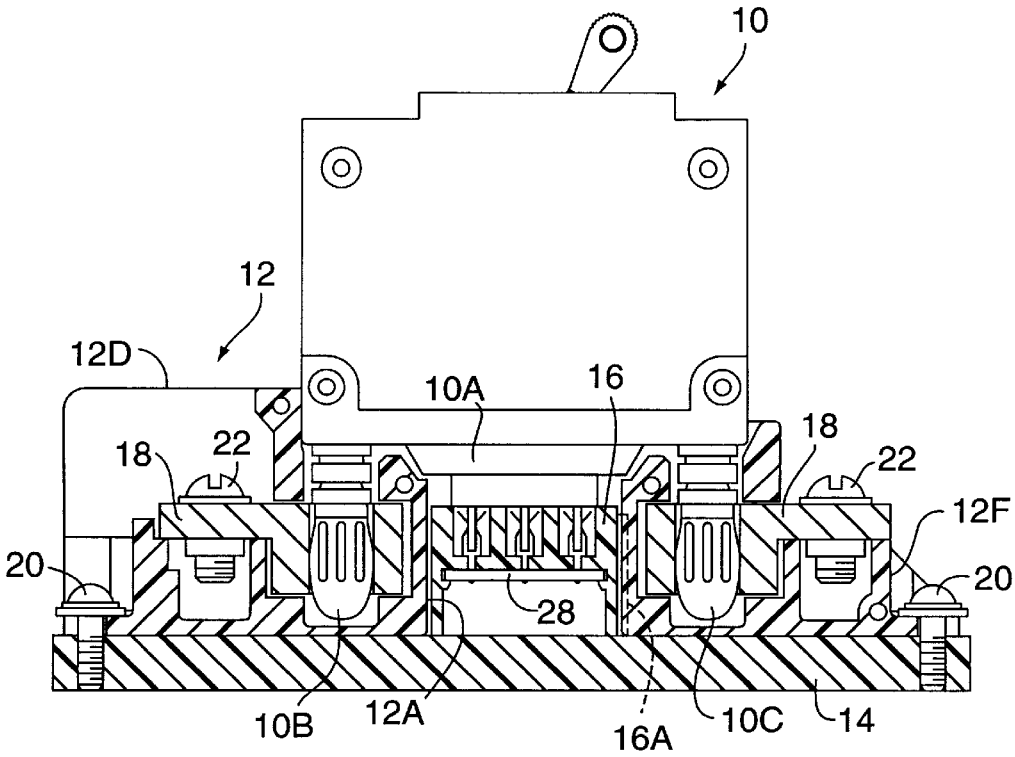
FIG. 9 is a vertical elevational view taken partly in section to illustrate the various components and their relationship with one another.

It will be apparent that the plate 13 shown in FIG. 1 cooperates with the bracket 12 in the same manner as would an adjacent bracket 12 to define a central opening 12A for receiving the auxiliary switch provided in the breaker 10, and for receiving the auxiliary switch connector 16 all as illustrated to better advantage in FIG. 9.

Figure 10:
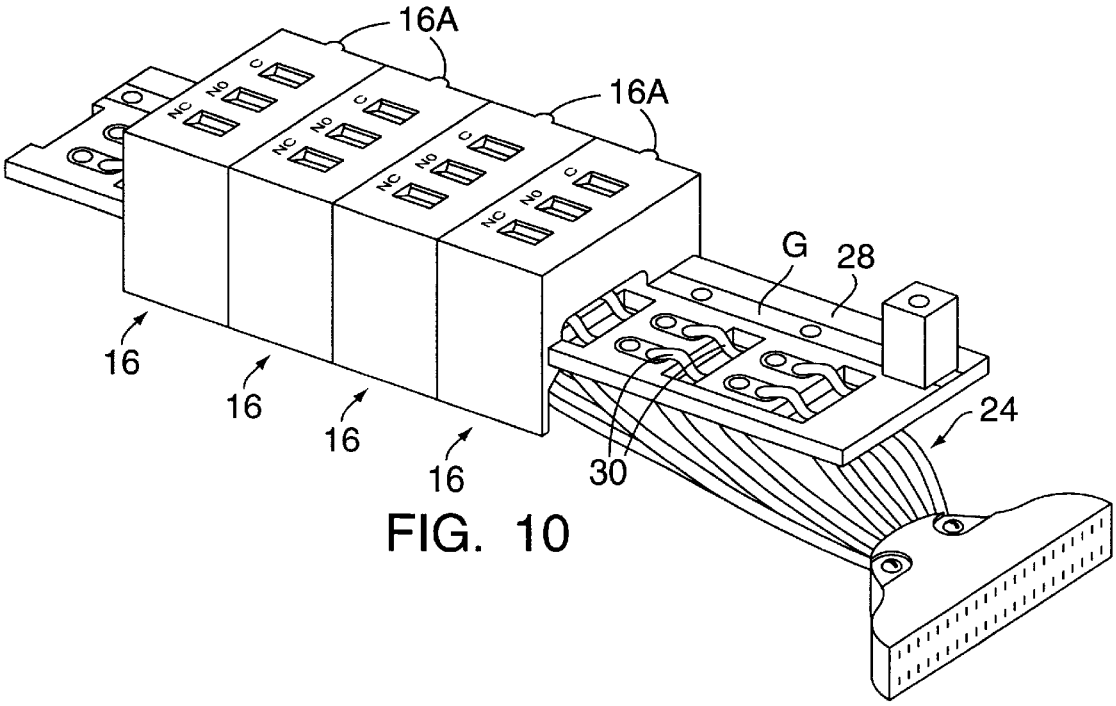
FIG. 10 is an isometric view illustrating a number of auxiliary or alarm switch connector plugs provided on the laterally extending circuit board which extends in the direction of the circuit breaker stack and a plurality of breakers provided in assembled relationship on a single back plate.

As best shown in FIG. 10 the auxiliary switch connectors 16, 16 are stacked in the same manner as are the brackets 12 and circuit breakers 10 to provide a compact assembly of auxiliary switch equipped circuit breakers in a single installation on a back panel or plate 14. Each of the individual brackets 12 is secured to this back plate 14 by screws as indicated generally at 20, 20 in FIG. 9.

Still with reference to the low profile mounting bracket 12, it will be apparent that each of these brackets defines suitable cavities for receiving the conductive coupling blocks 18, 18 associated with the line and load side of the circuit breaker. Preferably, and as shown, the terminals of the breaker are so shaped as to be releasably received in associated female openings provided for this purpose in these conductive coupling blocks 18. Additional openings are provided in these conductive coupling blocks 18 for wiring each of the individual circuit breakers. As best shown in FIG. 9 these additional line and load female openings are adapted to receive conventional studs 22, 22 best shown in FIG. 9 connecting each of the breakers 10 to an associated circuit.

Each alarm switch, and more particularly the terminals thereof are electrically connected to auxiliary or alarm switch wires indicated generally at 24 on FIG. 10. Preferably and as shown each of these alarm switch connectors 16 shares a common ground G also shown in FIG. 10. Further, each of the wires in the harness 24 are electrically connected to the normal closed and normal open sockets in the auxiliary switch connectors 16 as suggested by the conductive elements 30, 30 provided for this purpose in the printed circuit board 28. The PC board is in turn supported by the stack of auxiliary switch connectors 16 at a predetermined height above the panel 14 as best shown in FIG. 9.

Various modifications may be made to the basic structure described above, and it will be apparent that not all of the circuit breakers in the stack of breakers in a particular installation require auxiliary switches. Furthermore, the auxiliary switches can be seen to be carefully aligned with an associated breaker and bracket by providing locating ribs on the auxiliary switch connector 16 as illustrated for example at 16A of the drawings, with the result that corresponding grooves provided for this purpose in the central opening 12A of the bracket will serve to locate an associated auxiliary switch connector relative to its associated auxiliary switch in the breaker.

Figure 11:
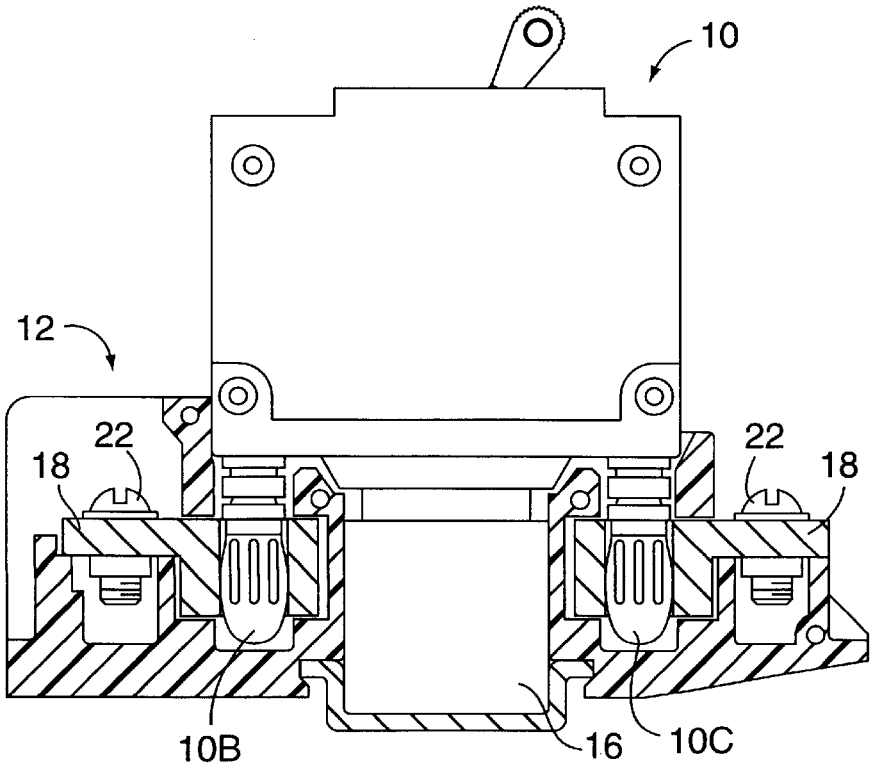
FIG. 11 is a side view partly in section showing an alternative embodiment of my invention.
Figure 3:
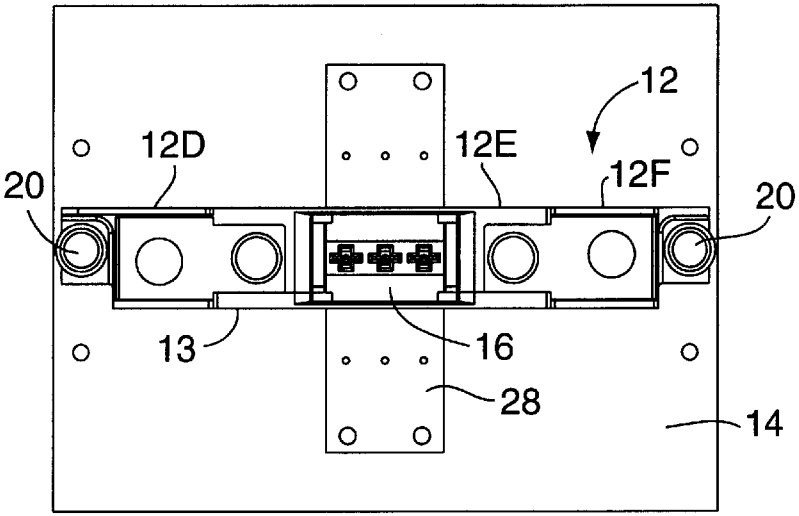
FIG. 3 is a view taken generally on the line 3—3 of FIG. 1 and illustrates the mounting bracket in a similar relationship with the back panel and printed circuit board as well as an auxiliary switch connector provided on the printed circuit board.
Figure 5:
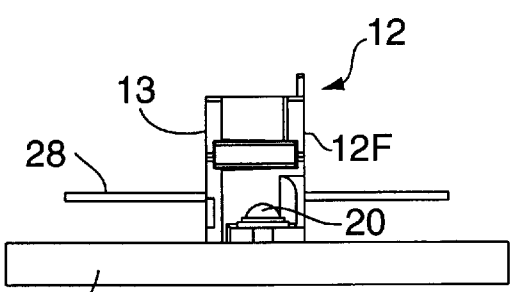
FIG. 5 is an end view of the assembly illustrated in FIG. 3.
Figure 4:
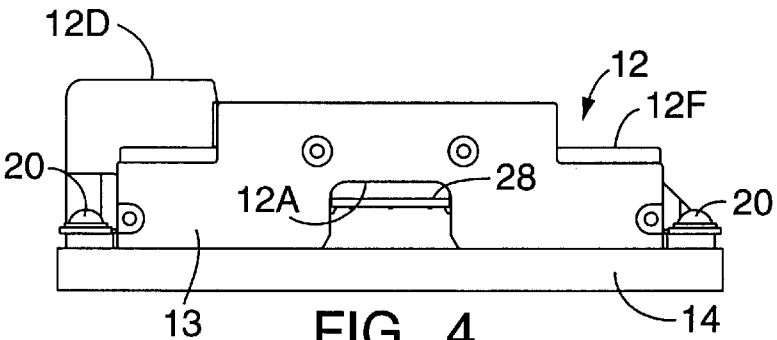
FIG. 4 is an elevational view of the assembly illustrated in FIG. 3.
Figure 6:
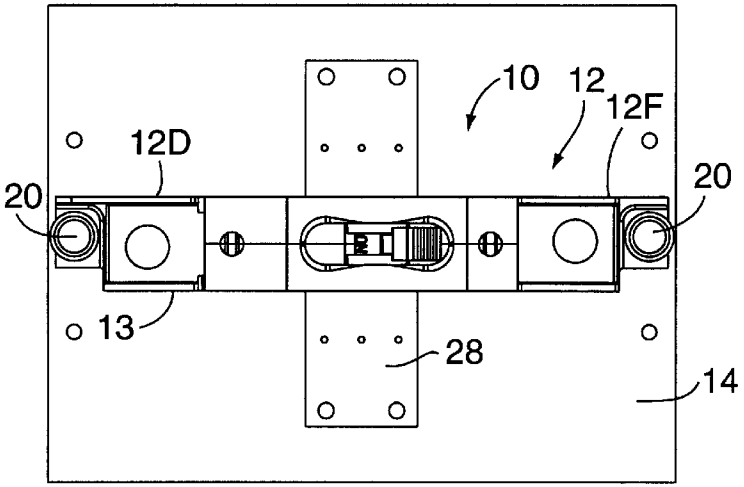
FIG. 6 is a view taken generally on the line 6—6 of FIG. 1.
Figure 8:
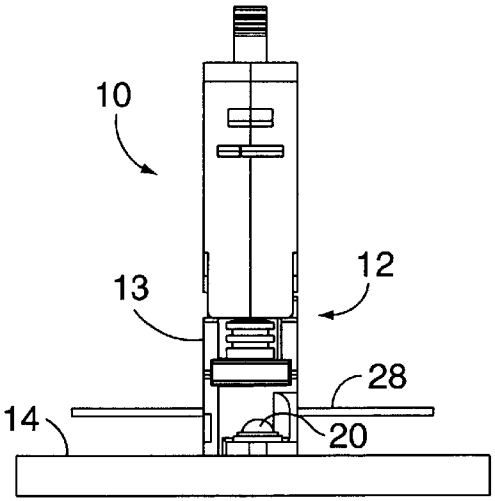
FIG. 8 is an end view of the assembly illustrated in FIG. 6.
Figure 7:
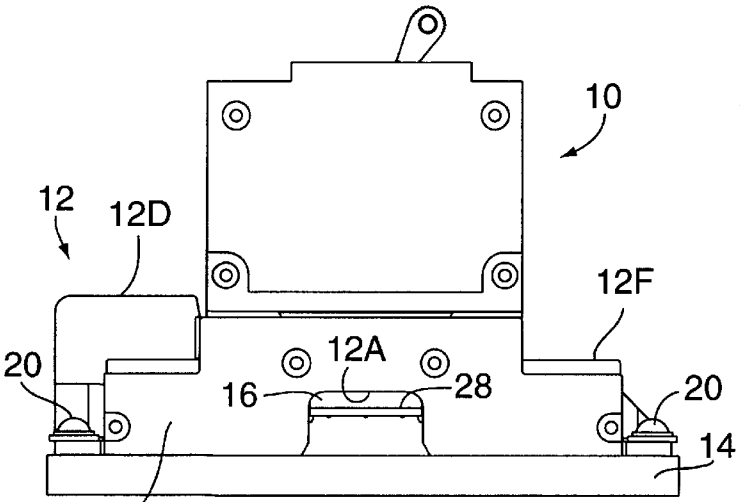
FIG. 7 is a side elevational view of the assembly illustrated in FIG. 6.

Other variations to the present invention will also be apparent from the subject disclosure, and instead of mounting the bracket 12 to a back plane or panel 14 such as described, another alternative would be to provide a DIN rail mounting mechanism on the lower side of the bracket 12 where a stack of such breakers is to be provided on a DIN rail instead of on a back plate or panel 14. Whereas the prior art suggests such DIN rail mounting means provided on the circuit breaker itself, as shown for example in U.S. Pat. No. 4,900,275, it will be apparent that these DIN rail locking means might instead be provided on the bottom of the bracket 12 described above with reference to the preferred embodiment shown. See FIG. 11 for a detailed showing of such a DIN rail mounting for a bracket of the type described and claimed herein.

In light of the above, it is therefore understood that within the scope of the appended claims the invention may be practiced otherwise than as specifically described and shown.

What is claimed is:

1. The combination comprising a split case molded circuit breaker housing having a well for accommodating an electrical switch, said housing having depending line and load male terminals;

a bracket for receiving the split case molded circuit breaker, said bracket having an opening for receiving said circuit breaker well and an electrical switch provided in said well;

said bracket being molded from a dielectric material and defining line and load terminal cavities spaced from said opening for receiving said circuit breaker well; and female terminals in said line and load terminal cavities, said female terminals having openings for receiving said depending line and load circuit breaker male terminals in said split case molded circuit breaker, said female terminals further including conductive connection means for coupling said line and load circuit breaker male terminals to a line and load conductor respectively.

2. The combination according to claim 1 further characterized by means for mounting said bracket to a panel.

3. The combination according to claim 2 wherein said means for mounting said bracket comprises fastener means extending through holes in said bracket and into threaded holes defined by the panel.

4. The combination according to claim 2 wherein said means for mounting said bracket comprises DIN rail mounting clips provided in said bracket, at least one mounting clip being reciprocally received in said bracket for releasably engaging the DIN rail.

5. The combination according to claim 2 further characterized by an elongated printed circuit (PC) board, and switch connector supports spanning said PC board and defining upwardly open conductive clips for receiving the blade terminals of the electrical switch, said conductive clips connected electrically to said PC board, and said connector supports supporting said PC board in spaced relation to the panel.

6. The combination according to claim 5 further characterized by a plurality of circuit breakers so received in a plurality of said brackets arranged adjacent to one another so that said elongated circuit breaker is supported by a plurality of said connector supports and each said connector support adapted to receive electrical switch blade terminals for electrically connecting selected circuit breakers to circuits of said PC board.

* * * * *